United States Patent [19]

Kankaanpää

[11] 4,224,104

[45] Sep. 23, 1980

[54] PAPER MANUFACTURING STRUCTURE PARTICULARLY FOR DETACHING A WEB FROM A WIRE

[75] Inventor: Matti Kankaanpää, Espoo, Finland

[73] Assignee: Valmet Oy, Finland

[21] Appl. No.: 922,800

[22] Filed: Jul. 7, 1978

Related U.S. Application Data

[63] Continuation-in-part of Ser. No. 787,334, Apr. 14, 1977, Pat. No. 4,113,557.

[30] Foreign Application Priority Data

Apr. 14, 1976 [FI] Finland ..... 761031
Oct. 11, 1977 [FI] Finland ..... 772990

[51] Int. Cl.[2] ..... D21F 2/00; D21F 3/10

[52] U.S. Cl. ..... 162/205; 162/305; 162/306; 162/307; 162/360 R; 162/360 DP

[58] Field of Search ..... 162/205, 305, 306, 307, 162/360 R, 360 DP, 364

[56] References Cited

U.S. PATENT DOCUMENTS

| | | | |
|---|---|---|---|
| 1,991,346 | 2/1935 | Ellis | 162/306 |
| 2,204,426 | 6/1940 | Millspaugh | 162/360 R X |
| 2,443,352 | 6/1948 | Hornbostel | 162/306 X |
| 3,351,521 | 11/1967 | Murray et al. | 162/307 |
| 3,884,756 | 5/1975 | Gustafson | 162/305 X |
| 4,055,461 | 10/1977 | Turunen | 162/306 X |
| 4,081,320 | 3/1978 | Wahren et al. | 162/205 |
| 4,086,131 | 4/1978 | Rempel et al. | 162/305 X |
| 4,163,688 | 8/1979 | Kankaanpää162 | 290 X/ |
| 4,172,759 | 10/1979 | Kankaanpää162 | 205/ |

FOREIGN PATENT DOCUMENTS 1178691 9/1964 Fed. Rep. of Germany ..... 162/307

*Primary Examiner*—Richard V. Fisher
*Attorney, Agent, or Firm*—Steinberg and Blake

[57] ABSTRACT

A paper machine has a forming wire loop which transports a web to a detachment transfer roll situated inside said wire loop at a detaching location where the web is to be detached from the wire and transported to a press section. A relatively dry felt engages the web on a sector of the detachment transfer roll at the detaching location and receives the web from the wire and continues to transport the web, while it adheres to the felt, to the press section. The detachment of the web from the wire on the detachment transfer roll is facilitated by the centrifugal force acting on the web which results from the substantial change of direction undergone by the web on the detachment transfer roll. In one embodiment, the press felt is directed to cover the web on a sector of the detachment roll by a press suction roll located on substantially the same level as the detachment transfer roll, the press roll having a suction sector which facilitates transfer of the web from the wire to the felt.

9 Claims, 7 Drawing Figures

PAPER MANUFACTURING STRUCTURE PARTICULARLY FOR DETACHING A WEB FROM A WIRE

BACKGROUND OF THE INVENTION

This application is a continuation-in-part of U.S. patent application Ser. No. 787,334, filed Apr. 14, 1977, now U.S. Pat. No. 4,113,557.

The present invention relates to paper-manufacturing methods and machines.

In particular, the present invention relates to methods and machines of this type which are concerned with the detaching of the paper web from the forming wire which may, for example, be a wire of a twin-wire former, with this wire transporting the web beyond the wire section to the press section.

The invention relates in particular to a method and apparatus of the above type which are designed to transport the web without any open draw from the wire to the press section of the paper machine, so that the web is continuously supported as it travels from the wire to the press section.

A detachment transfer roll inside the forming wire loop is utilized for contributing toward detaching of the web from the wire and adhering the web to a felt which transports the web from the wire to the press section.

As is well known, the operation in connection with which a web, which has been formed on the wire of a paper machine, is detached from the wire and transferred to the press section are extremely important, having a great influence on the reliability of the operation of the paper machine. In paper machines which operate at relatively low speeds, it is possible to utilize open draws resulting from a speed differential between the wire and press sections.

However, with paper machines which operate at high speeds or which are utilized in the manufacture of relatively thin and therefore low-strength paper, it is known that closed transfer systems, without any open draw, must be utilized, so that the web is continuously supported while it travels from the wire to the press section. Systems of this latter type usually operate in such a manner that a transfer felt of the press section is guided into contact with the web on the wire. Such a transfer felt may be pressed by way of a rotating roll against the web on the wire so that the web adheres to the felt to become detached from the wire and to continue to be transported by the felt which then tansports the web to the first press nip of the press section.

In general there are two main types of closed transfer systems. The simplest is the so-called lick-up transfer based on the capability of a wet "lick-up" felt to adhere the paper web to its surface. The other type of closed transfer system is a vacuum pick-up system which developed from the first system. By providing at the transfer point a vacuum, it is possible to reliably bring about transfer of the web from the wire to the felt with the web adhering reliably to the felt. A vacuum type of pick-up system offers greater possibilities than the first system, particularly for example, with regard to the selection of the quantity of the felt. Particularly in those cases where the transfer felt also operates as a press felt, several requirements are imposed on the transfer felt. These requirements include a requirement that the web must adhere reliably to the surface of the felt at the attaching location while on the other hand the felt must function efficiently at the dewatering first press nip of the press section.

In order for the web to reliably adhere to the felt between the detaching location and the first press nip, it has been conventional practice to use a relatively wet felt. However, where the transfer felt has also been employed as the press felt, the wetness of the felt, which is required to promote web adhesion, of course lessens the ability for dewatering the web at the first press nip. Thus, from the viewpoint of maximum efficiency in dewatering, it is desirable to maintain the felt as dry as possible.

Vacuum pick-up systems utilizing separate pick-up suction rolls have gained wide use. However, such conventional systems are encumbered by a number of drawbacks.

Thus, conventional suction rolls of the above type are expensive, requiring an individual driving motor and control system, and they are exceedingly noisy in operation. Furthermore, such suction rolls consume a great deal of air, due not only to the fact that the air which passes through the web and felt also enters into the suction system but also due to the fact that the air arriving in the suction zone in the holes of the suction roll shell must be moved out of these holes once during each revolution of the shell. The amount of such "hole air" may in large, fast running machines be twice or even three times the air quantity traversing the web. In addition, numerous difficulties result from the fact that proper seals must be maintained by sealing water at the suction box which forms part of the suction roll.

The detaching of the web from the wire in a conventional Fourdrinier machine utilizing a separate pick-up suction roll takes place at a location situated on the wire run between the couch roll and the traction roll. At this location the wire travels downwardly at an angle of approximately 45° with respect to a horizontal plane. This detaching location is determined by the usual construction of the wire section and press section and by their location with respect to each other. Subsequent to the detaching location the pick-up felt and the web adhering thereto lap the pick-up roll through an angle of about 45°–90°, and then the felt and web adhering thereto travel to the press section. This latter change in the direction of travel of the felt at the detaching location, caused by the above lapping of the pick-up roll by the felt, causes under some circumstances, such as high speed or an unsuitable felt, a tendency for the web to detach itself from the pick-up felt as a result of the action of centrifugal force. In order to counteract this latter tendency for detachment of the web from the felt while travelling on the pick-up roll, it is essential to provide the pick-up roll with a suction zone extending through a substantial distance beyond the detaching zone itself. In this way it is possible to insure that the web will remain adhered to the felt, but of course this reliability in the operation is obtained at the cost of a considerable additional load on the suction system of the pick-up roll. As a result, the suction roll requires a capacity in addition to that which would be required if the task of the suction roll were only to effect detachment of the web from the wire and adhering the web to the felt.

SUMMARY OF THE INVENTION

It is accordingly a primary object of the present invention to provide a method and apparatus capable of accomplishing an effective transfer of the web from the wire to a transfer felt while utilizing kinetic energy of the rotating structural elements of the wire section as well as of the web itself, while also making effective use of centrifugal force in various ways to contribute to detaching of the web from the wire and adhering thereof to the transfer felt while at the same time minimizing the number of required suction rolls, the expenditure particularly of suction energy, and the noise associated with the operation of such suction rolls.

According to the invention a web is carried by a wire to a detaching location where the web is detached from the wire without the use of a separate pick-up suction roll and is transported to a press section of a paper machine. A transfer felt travels to the detaching location to engage the web at the latter location. More particularly, the forming wire carrying the web is directed onto a sector of a detachment transfer roll. A relatively dry transfer felt is conduced onto the web on the detachment transfer roll sector. This transfer felt also functions as a press felt operating in one or several nips of the press section. The web is detached from the wire and transferred to the felt by virtue of adhesion forces of the felt and the centrifugal force acting on the web while it travels on the detachment transfer roll sector. With the web thus adhering to the surface of the felt, the latter travels to the first press nip of a press section for dewatering, this latter nip being a double-felted nip where the transfer felt itself forms the upper felt of the double-felted press nip. At the region of the first press nip the web is acted upon by suction provided by a press suction roll to assure retaining the web in engagement with the transfer felt which together with the web travels beyond the first press nip to a second press nip of the press section, this second press nip being formed by said suction roll and a smooth-surfaced roll of the press section.

The present invention is particularly applicable to modern twin-wire formers which offer greater possibilities, as compared with Fourdrinier wire sections, for selection of the detaching location in such a way that the advantageous web-detachment of the present invention can be applied.

At the stage where the transfer felt and the web adhering thereto arrive at the first press nip, where the transfer felt in the particular application of the present invention laps the upper roll of the first press nip, which is a suction roll, centrifugal force at this upper roll of the first press nip may tend to induce the web to become detached from the downwardly directed lower surface of the felt. In order to avoid such an occurrence, with the invention the suction zone of the upper press roll at the first press nip is extended to a location in advance of the first press nip so that the web is reliably maintained adhering to the transfer felt as the latter approaches the first press nip while curving around the press roll. At the same time, the so-called blowing phenomenon is avoided. In other words, detachment of the web from the felt owing to the phenomenon that in the throat formed by the pick-up or transfer felt and the surface of the suction roll a pressure is generated by the effect of air which the felt and the roll surface include between themselves.

An important feature of the invention is that the detachment of the web from the wire occurs at the detachment transfer roll where the carrying wire travels over a sector thereof greater than 90°, the wire and web thereon undergoing a substantial change of direction of travel. The centrifugal force arising from this substantial change of direction assists in the detachment of the web from the wire so that the suction force required to transfer the web from the wire to the felt can be minimized. The extent of the above substantial change in the direction of travel of the wire and the magnitude of the centrifugal force resulting therefrom depends upon the diameter of the roll around which the wire is guided as well as the machine speed. If the machine operates at high speed, then even a relatively minor change in direction may be considered as being substantial in the sense that under these conditions there will still be a tendency of the web to become detached from the wire as a result of centrifugal force. At a given machine speed, the centrifugal force created at a relatively small diameter roll is higher than that produced by a larger diameter roll, the centrifugal force being inversely proportional to the radius of such a roll.

A number of guide rolls are provided for the transfer felt which are appropriately located so that the felt encircles a segment of the suction roll of the press as well as covering the sector of the detachment transfer roll as described above. In one embodiment of the invention, the detachment transfer roll is located on substantially the same level as and in nip contact with the suction roll of the press section. As mentioned above, the press section suction roll is provided with a suction sector. In this embodiment, the suction sector is of sufficient extent such that it operatively extends into the transfer nip thereby facilitating detachment of the web from the wire as well as into first and second press nips. Since this suction sector on the press suction roll is covered both by the felt and the web adhering thereto, the amount of air passing therethrough, i.e., the required suction energy, is not unduly large. Thus, in this embodiment the suction sector of the press suction roll constributes to the detachment of the web from the wire, serves to affix the web to the felt, aids in the dewatering in the first nip of the press, detaches the web from the lower felt of the first press nip and assists in the dewatering of the second nip.

BRIEF DESCRIPTION OF DRAWINGS

The invention is illustrated by way of example in the accompanying drawings which form part of this application and in which.

DESCRIPTION OF PREFERRED EMBODIMENTS

Figure 1:
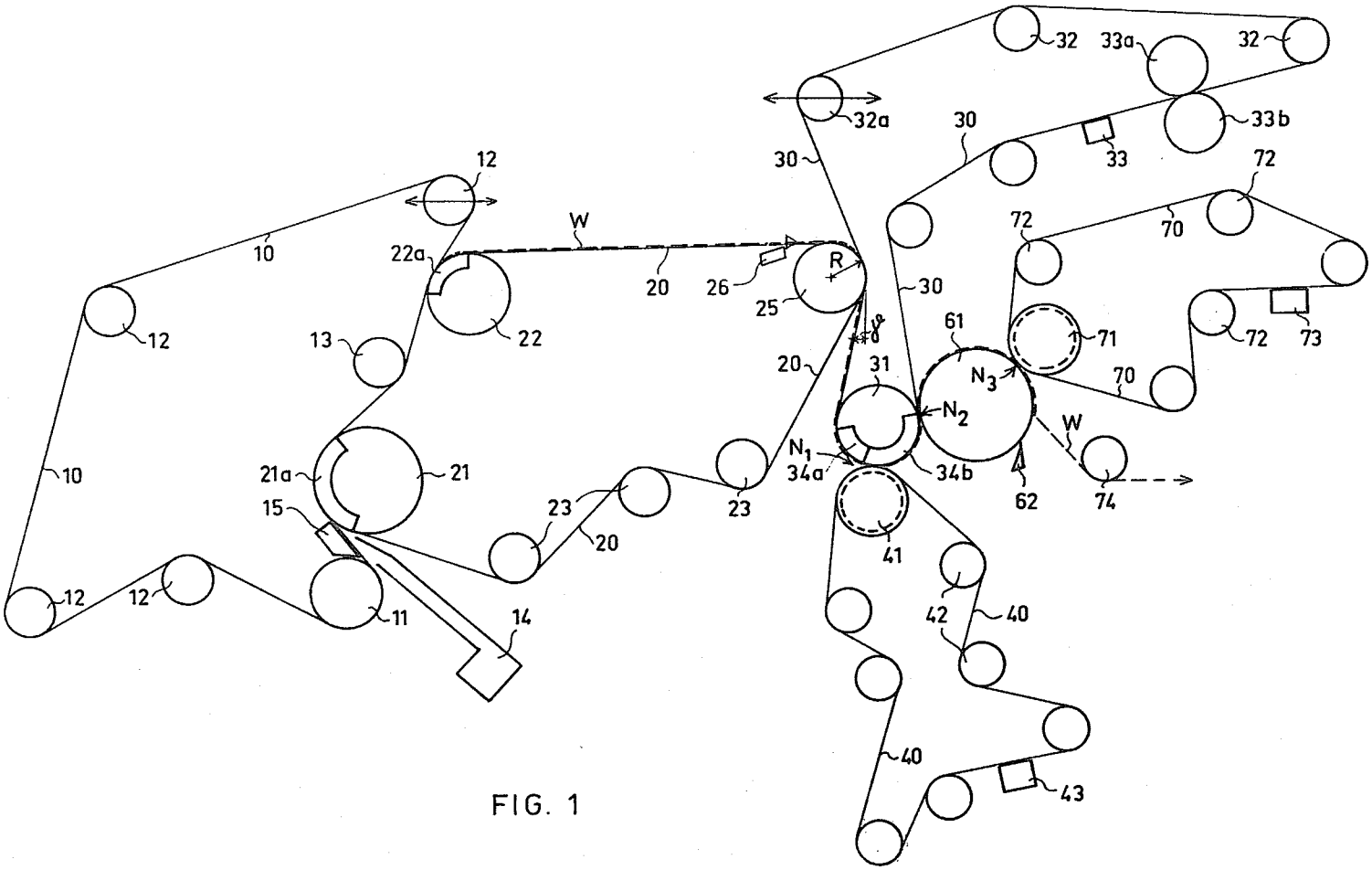
FIG. 1 is a schematic illustration of a machine according to the invention for carrying out the method of the invention, FIG. 1 illustrating a twin-wire former having one of its wires transporting the web to the detaching location with FIG. 1 showing not only how the web is detached from the wire at the detaching location but also how the web is then transported through the press section which is illustrated also in FIG. 1.

Referring first to FIG. 1, there is schematically illustrated therein the web-forming section as well as the press section of a paper machine. The web-forming section includes a pair of endless wire loops 10 and 20 which have portions travelling upwardly along a common path to provide in this way a twin-wire former. The wire 10 is guided by way of the rolls 12 and also engages a guide roll 13 situated at an intermediate location along the path of common travel of the twin wires. In addition, this particular wire 10 laps the breast roll 11 to form a single-wire portion receiving pulp stock from the headbox 14. The twin-wire former includes a lower forming roll 21, and a forming board 15 engages the single-wire portion extending from the breast roll 11 to the lower forming roll 21. The forming board 15 has either a solid wall or a perforated wall engaging the wire 10. The lower forming roll 21, which is situated within the wire loop 20 has a suction zone 21*a* in the region in which dewatering of the web takes place. This dewatering takes place simultaneously in opposed directions, namely outwardly away from the roll 21 as a result of centrifugal force and inwardly toward the latter through the suction zone 21*a*. The wires 10 and 20 travel along a common path upwardly beyond the lower forming roll 21, while being guided by the intermediate roll 13, to an upper forming roll or couch roll 22 provided with a suction zone 22*a* which assures that the web W which is formed, when travelling beyond the twin-wire forming path, will continue to be transported by the wire 20 toward the right beyond the upper forming roll 22, as viewed in FIG. 1. The wire 20 is guided by way of suitable guide rolls 23.

The detaching of the web W from the carrying wire 20 is accomplished upon the wires engaging a detachment transfer roll 25. Referring to FIG. 1 in conjunction with FIG. 1A, the wire 20 engages a sector of detachment transfer roll 25 designated $\beta$ which is somewhat larger than 90°. Transfer felt 30 is directed against detachment transfer roll 25 along a sector, designated $\alpha$ within sector $\beta$. Thus, in sector $\alpha$, there is a sandwich structure comprising carrying wire 20, the web W and the felt 30. The final detachment of web W from wire 20 as well as the attachment of web W to felt 30 occurs within sector $\alpha$ of detachment transfer roll 25. It should be noted that web W actually begins detaching from wire 20 prior to engagement with sector $\alpha$ by virtue of the effect of the centrifugal force acting on web W in the sector designated $\beta_o$ where the direction of the web carrying wire 20 first begins to change. This predetachment is actually a partial liberation of the web from the wire although contact between the web and wire is maintained in sector $\beta_o$.

In actual practice, the time interval wherein web W detaches from wire 20 is the same time interval during which wire 20 is in contact with the detachment transfer roll 25, namely the time it takes for a segment of wire 20 to traverse sector $\beta$ of roll 25. This detachment time is quite short. Thus, for example, if the velocity of wire 20 is 900 m per minute and the diameter of detachment transfer roll 25 is 760 mm and the combined extent of sectors $\beta_o$ and $\alpha$ is 90°, the detachment of the web W from the wire 20 must occur in approximately 0.04 seconds. Further, it is evident that the time in which the web W becomes attached to the felt 30 is the time in which a portion of felt 30 traverses sector $\alpha$ on detachment transfer roll 25 and, in the example given, is about 0.02 seconds.

The transfer felt 30 is guided by way of guide rolls 32, and a conditioning apparatus 33 is provided for the felt 33 as well as a washing press which has the rolls 33*a* and 33*b*. As is indicated schematically in FIGS. 1 and 2, the particular guide roll 32*a* is adjustable so that the transfer felt 30 can be guided to the detachment transfer roll in such a way that the felt 30 will cover the wire 20 and the web W thereon over an area or sector $\alpha$ of a suitable magnitude. In this way the attaching of the web W to the transfer felt 30 can be enhanced by increasing the extent of sector $\alpha$ thereby increasing the contact time of the felt 30 with web W and, therefore, maximizing the time for attachment of web W thereto.

The detachment of web W from wire 20 may also be promoted by increasing the time which wire 20 is in contact with the detachment transfer roll 25, i.e., by increasing the extent of sector $\beta$. This may be accomplished by locating detachment transfer roll 25 substantially higher relative to couch roll 22 than is shown in FIG. 1. For example, if detachment transfer roll 25 is upwardly displaced to a position higher than is shown in FIG. 1 so that wire 20 travels at an angle of 30° upwardly relative to the horizontal, the sector $\beta_o+\alpha$ in which the web is detached from wire 20 increases from 100° to 130°, that is, an increase of 30%, resulting in a corresponding increase in the time in which web W is engaged on detachment transfer roll 25.

Figure 3:
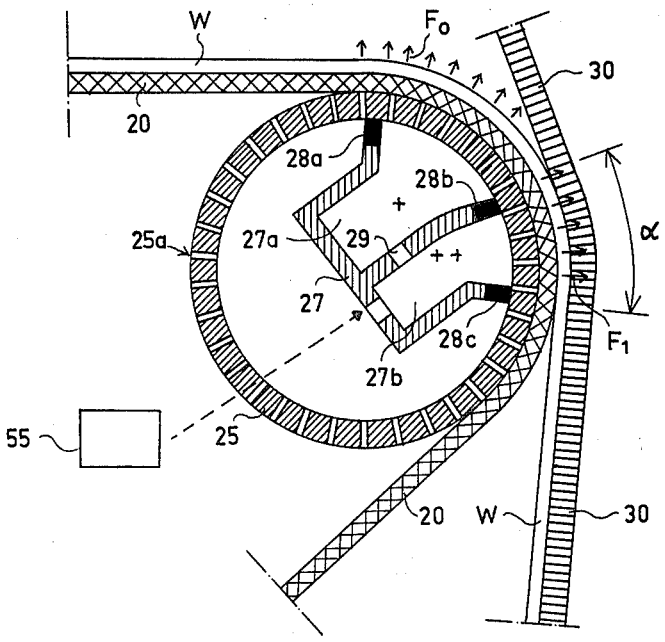
FIG. 3 is a fragmentary sectional schematic illustration of the detachment transfer roll of the present invention.
Figure 4:
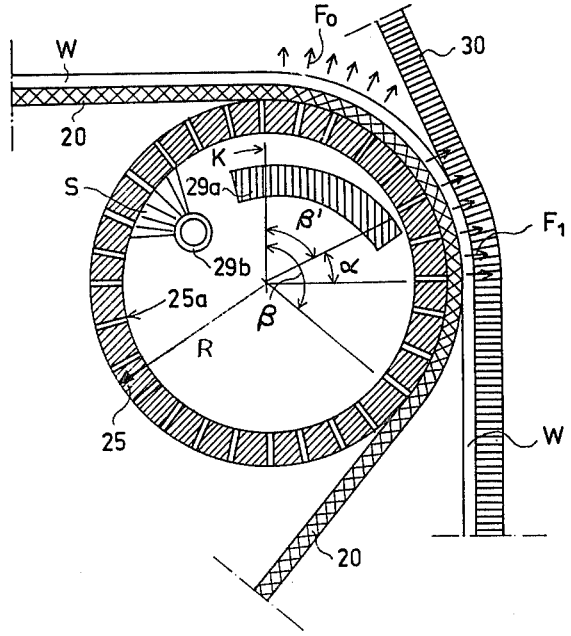
FIG. 4 is a fragmentary sectional schematic illustration of another embodiment of the detachment transfer roll of the present invention.

The detachment of web W from wire 20 may also be facilitated by the provision of blowing means in cooperation with sectors $\beta_o$ and $\alpha$. Such blowing means requires that the shell of detachment transfer roll 25 be foraminous. Two examples of the provision of such blowing means are illustrated in FIGS. 3 and 4, discussed below. Essentially, the flowing means provide a pressure differential which tends to detach the web from wire 20 and promote the attachment of the web to the felt 30.

Additionally, a similar blowing effect tending to detach web W from wire 20 may be provided by a foil strip 26 (FIG. 1), located at a suitable point adjacent to wire 20 in advance of detachment transfer roll 25. Thus, at high machine speeds, foil strip 26 produces an overpressure in the throat between the foil strip 26 and wire 20 which tends to initiate detachment of web W from the wire even before the web carrying wire reaches the detachment transfer roll 25. Thus, it is possible to utilize a differential pressure prior to the application of the centrifugal forces by the detachment transfer roll 25 as well as during and after the application of such forces.

Figure 2:
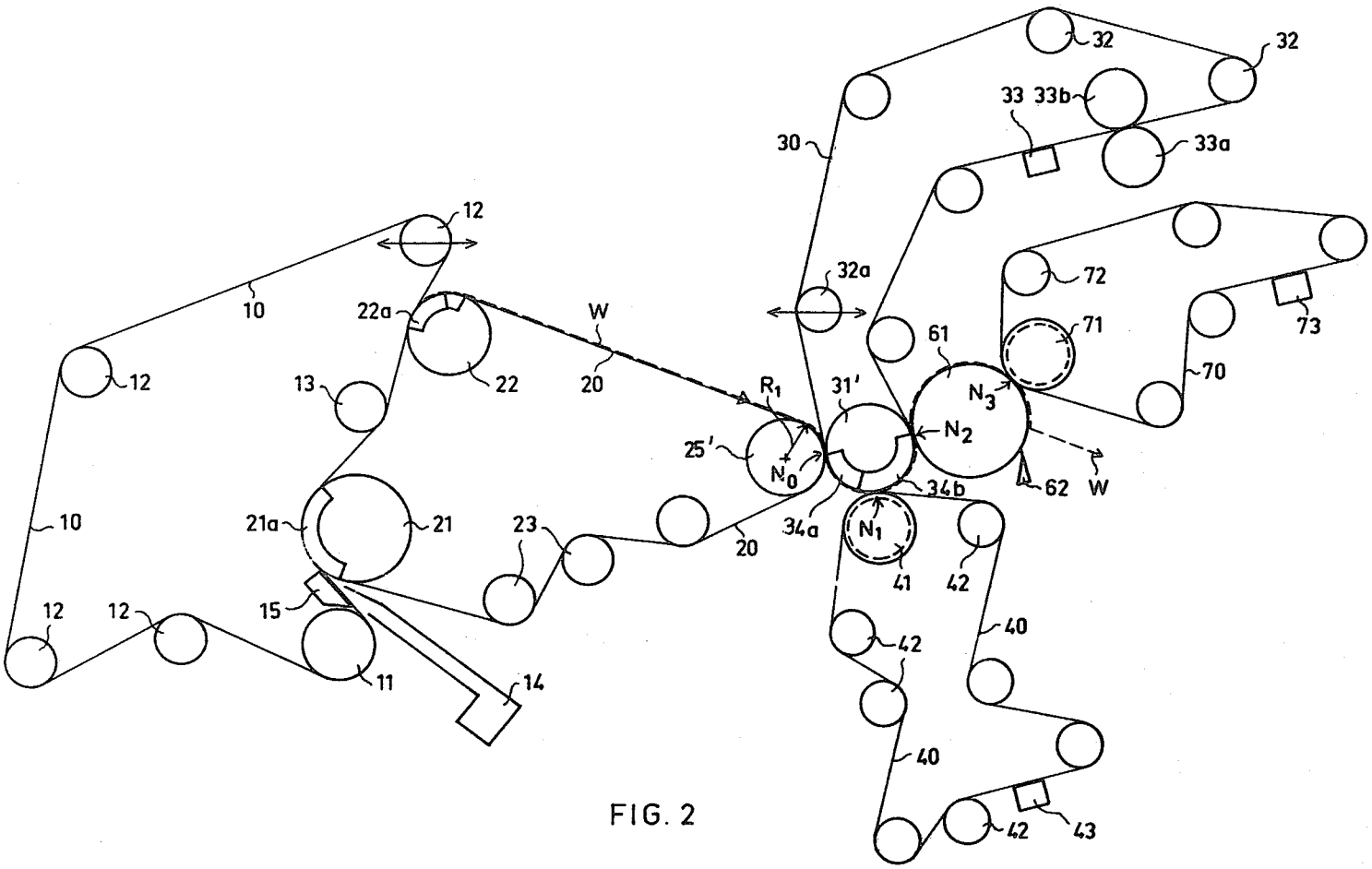
FIG. 2 is a schematic illustration of another embodiment of a machine according to the invention, the structure at the region of detaching location being different in FIG. 2 from that illustrated in FIG. 1.

As is apparent from FIGS. 1 and 2, the transfer felt 30 simultaneously serves as the upper felt at the first press nip $N_1$ of the press section of the paper machine. This first press nip is defined between press rolls 31 and 41, and the lower roll 41 is a water-accepting roll having a surface which is suitably recessed for this purpose. This lower roll 41 has its own felt loop 40 which is guided by way of guide rolls 42 and which is provided with a conditioning means 43. The upper roll 31 of the first press nip $N_1$ is a suction roll and is provided with a suction sector having one or more compartments 34*a*, 34*b*. The initial suction zone 34*a* extends in advance of the press nip $N_1$ to such an extent that any possible detachment of the web W from the felt 30 as a result, for example, of centrifugal force will be prevented. By providing the roll 31 with a plurality of suction sectors such as the sectors 34*a*, 34*b*, it is possible to minimize the required suction capacity. It is advantageous from the viewpoint of minimizing the required suction capacity to form the suction sector 34 in a continuous manner since if the holes of the suction roll 31 are filled with air between the suction compartments, an additional unnecessary load is exerted on the suction system.

The press section further includes a smooth-surfaced central roll 61 which together with the upper roll 31 of the first press nip forms the second press nip $N_2$, this roll 61 cooperating with a press roll 71 so as to define a third press nip $N_3$. The roll 71 has a recessed surface capable of receiving water. This roll 71 has its own felt loop 70, guided by guide rolls 72, and a felt conditioner 73 cooperates with the felt loop 70. The smooth-surfaced central press roll 61 is cleaned by a doctor blade 62. From the roll 61 the web is detached in a well known manner and while guided by a roll 74 travels to the drying section of the machine.

It will be noted that the wire 10 is guided by a guide roll 12 subsequent to the common path of travel of the wires 10 and 20, which is horizontally adjustable.

Referring now to FIG. 2, another embodiment of the present invention is depicted comprising a wire section and a press section substantially similar to that shown in the embodiment of FIG. 1. However, in the embodiment illustrated in FIG. 2, detachment transfer roll 25' is located on substantially the same horizontal level as the suction roll 31' of the press section, detachment transfer roll 25' and press suction roll 31' being contiguous and defining a transfer nip $N_o$ in which web W detaches from forming wire 20 and attaches to felt 30.

The transfer of web W from wire 20 to felt 30 is facilitated at least in part by the centrifugal force present by virtue of the change in direction of the web carrying wire 20 on detachment transfer roll 25' in a manner similar to the manner in FIG. 1. However, the transfer of web W to felt 30 is aided in the embodiment of FIG. 2 through the application of suction applied from suction sector 34*a* of press suction roll 31'. As described below, should it be found that the combination of the centrifugal forces and the suction forces are not sufficient to accomplish the transfer of web W from wire 20 to felt 30, the detachment transfer roll 25' may be provided with blowing means as shown in FIGS. 3 and 4 to increase the pressure differential required for the transfer. However, it is contemplated that in certain applications the centrifugal force and suction force will be sufficient and, in these cases, detachment transfer roll 25' may simply comprise a solid shell, either smooth or grooved. Further, the detachment and transfer of web W from wire 20 to felt 30 may be facilitated by the appropriate adjustment of the lineal pressure in the transfer nip $N_o$.

Turning now to FIGS. 3 and 4, two possible alternate constructions of detachment transfer roll 25 are illustrated. In both cases, the detachment transfer roll 25 is provided with blowing means for facilitating the detachment of web W from wire 20 and the attachment of web W to felt 30. Thus, referring to FIG. 3, it is seen that the web carrying wire 20 engages the roll 25 and substantially changes its direction thereby giving rise to an outwardly directed centrifugal force tending to detach web W from wire 20. Roll 25 is formed with a foraminous shell 25*a* having a bipartite blow chamber 27 defined by blow chambers 27*a*, 27*b* provided with sealing strips 28*a*, 28*b* and 28*c*. A source of compressed air 55 fluidly communicates with the interior of chamber 27*b* and, through an aperture 29 in the partition separating the adjacent blow chambers, communicates with blow chamber 27*a*. The overpressure in compartment 27*b* is preferably higher than the overpressure in compartment 27*a* due to the throttling effect of aperture 29 and due to the fact that the felt 30 covers web W adjacent compartment 27*b*.

Figure 1A:
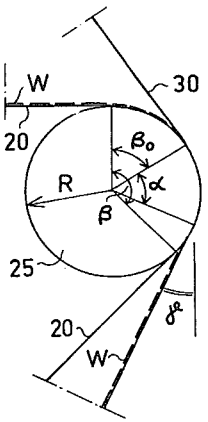
FIG. 1A is a schematic illustration of the detachment transfer roll of the present invention.

The sector defined between sealing strips 28*a* and 28*c* of the detachment transfer roll 25 shown in FIG. 3 corresponds to the sectors $\alpha+\beta_o$ shown in FIG. 1A while the sector defined between sealing strips 28*b* and 28*c* corresponds to the sector $\alpha$ (FIG. 1A) covered by the transfer felt 30. Thus, the overpressure created by compartment 27*a* facilitates the detachment of web W from wire 20 while the overpressure provided by compartment 27*b*, in addition to facilitating detachment, also facilitates attachment of web W to felt 30. Of course, the forces provided by the respective blowing compartments act simultaneously with the centrifugal forces created by the substantial change in direction of the web engaged on detachment transfer roll 25. The forces acting on the web over compartment 27*b* comprising the combination of centrifugal and overpressure forces are designated $F_1$.

Referring now to FIG. 4, another embodiment of the detachment transfer roll 25 is shown. Roll 25 is defined by a foraminous shell 25*a*. However, rather than being provided with blow chambers as shown in FIG. 3, the detachment transfer roll 25 houses an arcuate shoe 29*a*. The rotation of roll 25 produces a clockwise circulating air flow and shoe 29*a* defines a throat K through which the circulating air moves resulting in a blowing effect. In the case of the detachment transfer roll 25 shown in FIG. 4, the detachment of web W from wire 20 and its attachment to web 30 occurs in the sector $\beta'+\alpha$. Of course, centrifugal forces are acting concurrently on web W in addition to the blowing effect and the natural surface adhesion of web W to felt 30, the latter of which is effective over sector $\alpha$, the combination of forces acting over sector $\alpha$ being designated $F_1$. The relative strength of each of these factors depends on the velocity of wire 20, on the diameter of detachment transfer roll 25 and on the adhesive forces of the felt 30 to the web W.

Still referring to FIG. 4, a source of water 29*b* may be provided to further facilitate detachment of web W from wire 20. Thus, the water is sprayed from source 29*b* as a fine spray S onto the inner surface of roll 25 whereupon it is driven by centrifugal force through openings 25*a* in the shell of the roll onto the meshes of wire 20. The quantity of water is relatively minimal and does not adversely affect the moisture content of the web W.

Figure 5:
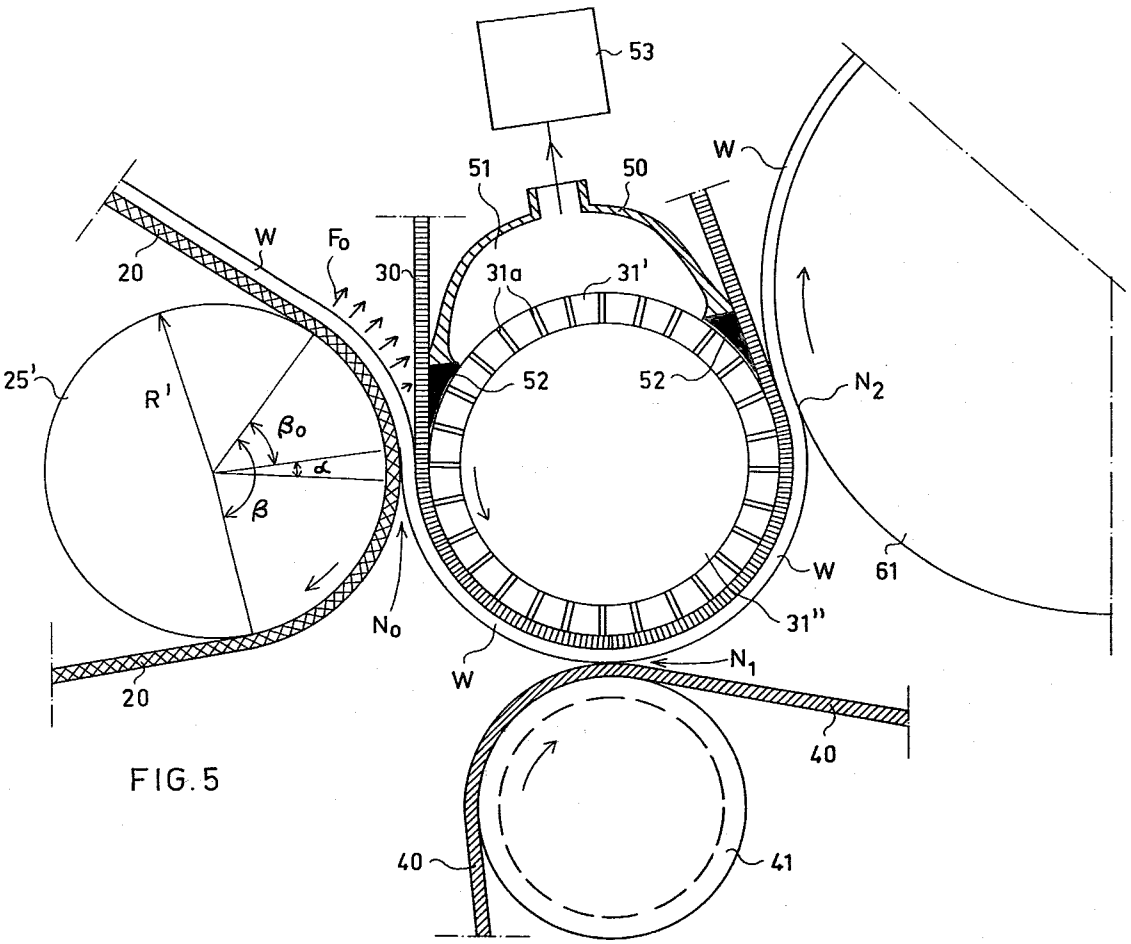
FIG. 5 is a fragmentary sectional schematic illustration of a detachment transfer roll according to the embodiment shown in FIG. 2, i.e., mounted in connection with the press suction roll.

Referring now to FIG. 5, the detachment transfer roll 25' is shown in a position contiguous with the suction roll 31' of the press section in a manner corresponding to the embodiment of FIG. 2. The suction roll 31' is constructed of a foraminous shell and the mouth of an external suction box 50 extends over the sector of suction roll 31' not covered by felt 30. A vacuum system 53 communicates with the interior of suction box 50 and the interior 31'' of roll 31' creating a suction through perforations 31*a* of the suction roll which acts through felt 30 on the web W thereby facilitating the transfer of web W onto felt 30. Seals 52 are provided on the edges of suction box 50 to confine the area of suction roll surface through which the suction is effective.

As shown in FIG. 5, the detachment transfer roll 25' and the suction roll 31' of the press together define a transfer nip $N_o$, Prior to web W arriving at the transfer nip $N_o$, i.e. while it is still carried on wire 20, a pre-detachment effect is produced by the centrifugal forces created by the change in direction of the web carrying wire 20 as it is engaged by the detachment transfer roll 25' over the sector $\beta_o$. This centrifugal force is denoted by $F_o$. Thus, the transfer of web W onto felt 30 occurs on sector $\alpha$ of detachment transfer roll 25', which sector is fairly small.

Referring now to FIGS. 1 and 2, the headbox 14 of course supplies pulp stock to the wire 10 to be delivered to the twin-wire former with water escaping to some extent at the forming board 15 in advance of the forming roll 21 although dewatering primarily takes place at the forming roll 21. The dewatering continues at a lesser rate at the guide roll 13 with some dewatering also taking place at the couch roll 22. The suction sector **22*a* of the roll 22 causes the web W to remain attached to the wire 20 so as to be carried thereby to the detachment transfer roll 25 (25' in FIG. 2). At the latter location the transfer felt 30, which also forms part of the press section, contacts the web W so that it is detached from wire 20 and adheres to the felt 30** as described hereinabove.

The web W which is attached to the felt 30, travels with the felt 30 to the first press nip $N_1$ for dewatering. Thus the first press nip is defined between the upper suction roll 31 (31' in FIG. 2) within the transfer felt loop and the lower press roll 41 which is a water-accepting roll having a suitably grooved surface, for example. This roll 41 of course has its own felt 40. Subsequent to the first press nip the web W remains attached to the felt 30 as a result of the suction prevailing at the zone 34 of the suction roll 31, and thus the web is transferred with the felt 30 to the second press nip $N_2$.

At the second press nip $N_2$, defined between the roll 31 (31' in FIG. 2) and the smooth-surface roll 61 which forms the central roll of the press section, the felt 30 also is compressed together with the web W, but at this point the web W becomes detached from the felt 30, adheres to the surface of roll 61, and travels together with the roll 61 to the third press nip $N_3$. This third press nip $N_3$ is provided by situating in cooperation with the roll 61 a water-accepting roll 71 which has its own felt loop 70, as pointed out above. This roll 71 is also a roll such as a grooved roll capable of accepting water, and at the third press nip $N_3$ the web is further dewatered so that the dry matter content thereof increases. The web however still adheres to the smooth-surface roll 61 and subsequent to the third press nip $N_3$ there may still be one more press nip although such an additional press nip has not been illustrated. Instead the web W has been shown as being detached from the roll 61 in a conventional manner, as a result of the differential speed, and it is then transported to the drying section of the paper machine which in itself is well known.

From the foregoing it is apparent that an important feature of the present invention is that the transfer felt 30, which also functions as a pressing felt, can be maintained in a relatively dry condition. Of course, this fact enhances the dewatering of the web in the press section. The transfer felt 30 can be maintained in its relatively dry condition since the attachment of the web W to felt 30 and its subsequent adherence thereto does not depend on water film adhesion as is common in prior art apparatus. Thus, referring to FIG. 1, there are no gravitational forces acting to detach web W from felt 30 since the web is maintained on the upwardly facing surface of the felt in its travel between detachment transfer roll 25 and suction roll 31. Upon reaching the suction roll 31, there is still no need for water film adhesion since the web W is maintained on felt 30 through the suction supplied by press suction roll 31.

As mentioned above, in view of its operation in dry condition, felt 30 is provided with felt conditioning means 33 and, further, pressing means **33*a*, 33*b*. Additionally, in view of its operation in a dry condition, it is now possible to select a particular type of felt for felt 30** which is most favorable from the viewpoint of the pressing or dewatering process since the adhesion properties of the felt to the web are no longer of primary importance.

Thus, the principles of operation and the advantages derived therefrom of the present invention can be summarized as follows. An important advantage of the invention is that the felt 30 operates in a relatively dry condition. This is made possible by the fact that subsequent to web W being transferred from wire 20 onto felt 30, the web carrying felt, as shown in FIG. 1, travels under an "excess angle" $\gamma$ with respect to the vertical until it reaches suction sector **34*a* of press suction roll 31. This is in contradistinction to prior art apparatus where it has been conventional for the web to "hang" on the downwardly facing surface of the felt thereby requiring a higher water content for the felt in order to obtain sufficient adhesion to the web. However, in the present invention, the web carrying felt 30 travels in a substantially vertical direction or even under "excess angle" $\gamma$ from the detachment transfer roll 25 to the first press nip, thereby negating any gravity effect which would tend to promote detachment of the web from the felt. Another advantage of the present invention is that by providing a large or substantial change in direction to the web carrying wire 20, detachment of the web from the wire and its subsequent attachment to the felt is facilitated. More particularly, by directing wire 20 over a relatively large sector $\beta$ of detachment transfer roll 25, a correspondingly large detachment sector $\beta_o+\alpha$ is obtained where the centrifugal forces promote detachment of the web from the wire and attachment to the felt. Of course, this is in addition to the natural gravity forces which promote adhesion of the web to the felt resulting from the "excess angle" $\gamma$ which defines the direction of travel of the web carrying felt. Referring to FIGS. 2 and 5, the present invention allows for the immediate transfer of the web W to the suction sector 34 of press suction roll 31' at transfer nip $N_o$ thereby insuring that the web W is maintained on the felt 30** for transport to the first press nip $N_1$.

It is evident from the above that another advantage offered by the present invention is that the detachment of the web from the wire and its transfer to the felt may be optimized by varying any one or more of several different parameters. Thus, assuming a particular velocity of web W and its moisture content at the point of transfer, the parameters available for variation to optimize the transfer include the radius R (R' in FIG. 2) of the detachment and transfer roll 25, the magnitude of the sectors $\beta_o$, $\beta$ and $\alpha$ of roll 25 (as well as their relative sizes), and the angle $\gamma$. These parameters are selectively variable over a wide range for optimization of the web detachment and transfer. Further, in the case of the embodiment shown in FIGS. 2 and 5, the detachment and transfer of the web from the wire to the felt may be further controlled through the selection of the nip pressure in the transfer nip $N_o$. Additionally, the quality of the felt 30 may be selected with a view toward facilitating the detachment and transfer of the web as well as subsequent pressing operations as will be understood by those skilled in the art.

Referring to FIG. 1A, predetachment of web W from wire 20 occurs on sector $\beta_o$ of detachment transfer roll 25 through the action of centrifugal force $F_o$, the magnitude of which per unit mass of the web is $F_o = mv^2/R$, as is well known. Subsequent to the predetachment interval, i.e., subsequent to travel over sector $\beta_o$, upon felt 30 coming into contact with web W, the transfer of web W to felt 30 begins. This is denoted by sector $\alpha$ in FIG. 1A. A centrifugal force $F_o$ continues to act on web W as it traverses over sector $\alpha$, thereby moving the web towards felt 30.

Figure 5A:
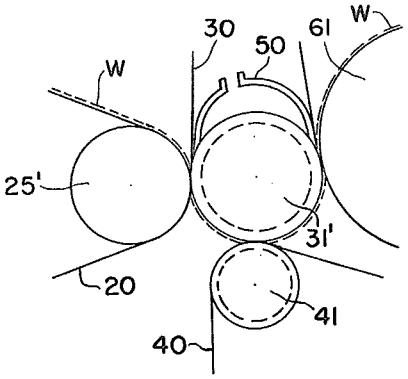
FIG. 5A is a fragmentary schematic illustration of the embodiment illustrated in FIG. 5 wherein the press suction roll comprises a recessed roll.

It should be understood that the particular construction of the press section and of the members preceding it which serve to transport web W may be varied from that shown in the Figures. For example, in the embodiment of the invention illustrated in FIGS. 2 and 5, the detachment transfer roll 25' and press suction roll 31' may be located at a considerably higher level relative to couch roll 22 thereby increasing the interval where centrifugal forces act to promote detachment of the web as described above. Further, it is within the scope of the present invention to provide in the case of the embodiment shown in FIG. 5 a conventional suction compartment within press suction roll 31' for further facilitating transfer of the web to the felt and for promoting dewatering in nips $N_1$ and $N_2$. Where external suction box 50 is employed, perforations 31*a* may be replaced with grooves extending around the outer surface of suction roll 31' along which the suction effect is directed through felt 30 on web W as shown in FIG. 5A. Seals 52 of suction box 50 may be constructed in a number of different ways.

It is understood that the invention is not limited with respect to the wire former apparatus shown in FIGS. 1 and 2 but, for example, can be used in connection with a conventional Fourdrinier wire section. Further, the invention is not limited to the particular design of the press section shown in FIGS. 1 and 2 since it is possible to leave out one of the dewatering press nips $N_1$ or N. Further, an equalizing nip without a felt may be provided in association with central roll 61 in place of $N_3$. In connection with the embodiments shown in FIGS. 2 and 5, a source of steam or other overpressure may be provided in the areas between nips $N_o$, $N_1$ and $N_2$ where the web is supported by felt 30 for promoting dewatering and the maintenance of the web on the felt. In this respect, reference is made to applicant's U.S. patent application 790,421, now U.S. Pat. No. 4,163,688.

Of course, the invention is in no way confined to the above embodiments, described in detail above and shown in the drawing, inasmuch as the details of the inventive concept may vary within the scope of the claims which follow below.

What is claimed is:

1. A method for operating a paper manufacturing machine wherein a web is detached from a forming wire loop and conducted to a press section of the machine by a transfer felt, comprising the steps of:

conducting the web carrying forming wire into engagement with a first sector of a detachment transfer roll situated inside said wire loop over which the direction of travel of the web substantially changes;

conducting the transfer felt in a relatively dry condition into engagement with the web over a second sector within said first sector of the detachment transfer roll, said transfer felt also functioning as a pressing felt partially operating in at least one of the press nips in the press section;

providing a press suction roll contiguous with the detachment transfer roll defining a transfer nip at the second sector through which the transfer felt is conducted and in which the detachment of the web from the wire and transfer to the felt occurs; the press suction roll being provided with at least one external suction compartment for applying suction from the suction roll in said transfer nip and at least one of the press nips;

applying suction from said press suction roll to said web in the transfer nip and in at least one of the press nips;

detaching said web from said forming wire and transferring it to said felt under the relative prolonged action of centrifugal force acting on the web by virtue of the change of direction of the web over at least a portion of the first sector of the detachment transfer roll and simultaneous adhesion forces which cause said web to adhere to the outer side of the felt, said web detachment being further facilitated by said application of suction in the transfer nip from the suction roll; and transporting the web on the transfer felt from the transfer nip to the first dewatering press nip of the press section.

2. A method as recited in claim 1 wherein during the step of transporting the web on the transfer felt from the transfer nip to the first dewatering press nip of the press section, the web is supported on the felt by at least the suction from the press suction roll and including the further step of transporting the web on the transfer felt from the first press nip to a second dewatering press nip with the web being supported on the felt by at least the suction from the press suction roll.

3. A method for operating a paper manufacturing machine wherein a web is detached from a forming wire loop and conducted to a press section of the machine by a transfer felt, comprising the steps of:

conducting the web carrying forming wire into engagement with a first sector of a detachment transfer roll situated inside said wire loop over which the direction of travel of the web substantially changes;

conducting the transfer felt in a relatively dry condition into engagement with the web over a second sector within said first sector of the detachment transfer roll, said transfer felt also functioning as a pressing felt partially operating in at least one of the press nips in the press section;

predetaching the web from the forming wire on a third sector within said first sector of the detachment transfer roll prior to said second sector, whereby a centrifugal force acts on said web in said third sector to predetach it from said forming wire;

providing an overpressure working in the same direction as the centrifugal force at said detachment transfer roll for facilitating at least on said third sector the detachment of the web from the forming wire and its transfer to the felt, said overpressure being obtained by providing a throat defining baffle within the detachment transfer roll and openings in the surface of said transfer roll for communication of said overpressure to said web;

detaching said web from said forming wire and transferring it to said felt under the relatively prolonged action of centrifugal force acting on the web by virtue of the change of direction of the web over at least a portion of the first sector of the detachment transfer roll and simultaneous adhesion forces causing said web to adhere to the outer side of the felt; and transporting the web on the transfer felt to the first dewatering press nip of the press section.

4. A method as recited in claim 3 further including the step of spraying water inwardly into the web carrying wire to facilitate detachment of the web therefrom.

5. A method for operating a paper manufacturing machine wherein a web is detached from a forming wire loop and conducted to a press section of the machine by a transfer felt, comprising the steps of:

conducting the web carrying forming wire into engagement with a first sector of a detachment transfer roll situated inside said wire loop over which the direction of travel of the web substantially changes;

conducting the transfer felt in a relatively dry condition into engagement with the web over a second sector within said first sector of the detachment transfer roll, said transfer felt also functioning as a pressing felt partially operating in at least one of the press nips in the press section;

detaching said web from said forming wire and transferring it to said felt under the relatively prolonged action of centrifugal force acting on the web by virtue of the change of direction of the web over at least a portion of the first sector of the detachment transfer roll and simultaneous adhesion forces causing said web to adhere to the outer side of the felt; and transporting the web on the transfer felt to the first dewatering press nip of the press section by moving the web carrying felt downwardly in a substantially vertical direction to the first press nip.

6. Apparatus in a paper manufacturing machine for detaching a web from a loop of forming wire and conducting the web to a press section of the machine by a transfer felt, comprising:

a detachment transfer roll located within said wire loop;

means for conducting the wire into engagement with a first sector of said detachment transfer roll over which the direction of travel of the web substantially changes;

a transfer felt for transporting the web to the machine press section, said transfer felt further functioning as a pressing felt in at least one of the press nips in the press section;

a press suction roll located in said machine press section, said web carrying transfer felt being engaged with said press suction roll, and said detachment transfer roll being located at a vertically elevated position with respect to said press suction roll such that said web carrying felt travels in a substantially vertical direction from said detachment transfer roll to said press suction roll;

means for pressing said transfer felt to a relatively dry condition before engaging the web over a second sector within said first sector of the detachment transfer roll;

whereby said web detaches from the forming wire and is transferred to said felt under the relatively prolonged action of the centrifugal force acting on the web by virtue of the change of direction of the web over at least a portion of said first sector of said detachment transfer roll, said web adhering to the outer side of the felt by adhesion forces; and means for conducting the web carrying transfer felt to the first press nip of the press section.

7. Apparatus as recited in claim 6 wherein said direction of travel of said web carrying felt is at a small excess angle with respect to the vertical so that the web is carried on the upwardly facing surface of said felt.

8. Apparatus in a paper manufacturing machine for detaching a web from a loop of forming wire and conducting the web to a press section of the machine by a transfer felt, comprising:

a detachment transfer roll located within said wire loop;

means for conducting the wire into engagement with a first sector of said detachment transfer roll over which the direction of travel of the web substantially changes;

a transfer felt for transporting the web to the machine press section, said transfer felt further functioning as a pressing felt in at least one of the press nips in the press section;

a press suction roll located in said machine press section, said web carrying transfer felt being engaged with said press suction roll, said suction roll being located contiguous with said detachment transfer roll to define a transfer nip, and said press suction roll comprising a foraminous shell including a suction box located externally with respect to the shell of said press suction roll, said suction box being operatively associated with means for providing suction, said suction box directing suction to said web tending to facilitate tansfer and adherence of said web to said felt;

means for pressing said transfer felt to a relatively dry condition before engaging the web over a second sector within said first sector of the detachment transfer roll;

whereby said web detaches from the forming wire and is transferred to said felt under the relatively prolonged action of the centrifugal force acting on the web by virtue of the change of direction of the web over at least a portion of said first sector of said detachment transfer roll, said web adhering to the outer side of the felt by adhesion forces;

and means for conducting the web carrying transfer felt to the first press nip of the press section.

9. Apparatus in a paper manufacturing machine for detaching a web from a loop of forming wire and conducting the web to a press section of the machine by a transfer felt, comprising:

a detachment transfer roll located within said wire loop;

means for conducting the wire into engagement with a first sector of said detachment transfer roll over which the direction of travel of the web substantially changes;

a transfer felt for transporting the web to the machine press section, said transfer felt further functioning as a pressing felt in at least one of the press nips in the press section;

a press suction roll located in said machine press section, said web carrying transfer felt being engaged with said press suction roll, said suction roll being located contiguous with said detachment transfer roll to define a transfer nip, and said press suction roll comprising a solid shell having a grooved surface and further including a suction box located externally with respect to the shell of said press suction roll, said suction box being operatively associated with means for providing suction, said suction box directing suction to said web tending to facilitate transfer and adherence of said web to said felt;

means for pressing said transfer felt to a relatively dry condition before engaging the web over a second sector within said first sector of the detachment transfer roll;

whereby said web detaches from the froming wire and is transferred to said felt under the relatively prolonged action of the centrifugal force acting on the web by virtue of the change of direction of the web over at least a portion of said first sector of said detachment transfer roll, said web adhering to the outer side of the felt by adhesion forces; and means for conducting the web carrying transfer felt to the first press nip of the press section.

* * * * *